United States Patent [19]

Baum et al.

[11] Patent Number: 5,013,032

[45] Date of Patent: May 7, 1991

[54] CHILD WALKER-TRAINER

[76] Inventors: Lloyd Baum, 25742 Hinckley St., Loma Linda, Calif. 72354; Dan E. Fischer, 1345 E. 3900 South, Salt Lake City, Utah 84124

[21] Appl. No.: 258,147

[22] Filed: Oct. 14, 1988

[51] Int. Cl.[5] ..... A61H 3/00; A47D 13/04

[52] U.S. Cl. ..... 272/70.3; 135/67; 280/87.021; 280/47.371; 297/6

[58] Field of Search ..... 272/70.3, 70; 135/67, 135/65; 280/87.021, 47.26, 47.371, 87.051, 47.16, 47.17, 47.2, 47.23, 47.24, 47.34; 297/5, 6, 7; 188/5, 19, 20, 22, 23

[56] References Cited

U.S. PATENT DOCUMENTS

| | | | |
|---|---|---|---|
| Re. 24,817 | 4/1960 | Hogan | 297/6 |
| 1,729,557 | 9/1929 | Stoll . | |
| 2,224,246 | 12/1940 | Ames | 155/22 |
| 2,591,912 | 4/1952 | Block | 155/22 |
| 3,397,883 | 8/1968 | Kiehn | 272/70.3 |
| 4,211,309 | 7/1980 | Ruggiero | 272/70.3 |
| 4,700,730 | 10/1987 | Samuelson et al. | 135/67 |

*Primary Examiner*—Stephen R. Crow

*Attorney, Agent, or Firm*—Workman, Nydegger & Workman

[57] ABSTRACT

This invention relates to a child walker-trainer. The walker-trainer consists of a frame preferably in the form of a push toy. At least three wheels are mounted to the frame. At least one of the wheels is mounted axially to the frame to form a rear wheel axis rearward of the other wheels. The invention preferably includes two rear wheels and two forward wheels. A handle attached to the frame extends upwardly and rearwardly of the rear wheel axis such that a downward force applied to the handle causes the walker-trainer to pivot along the rear wheel axis. The invention includes means for immobilizing the walker-trainer when a downward force is applied to the handle which causes the walker-trainer to pivot along the rear wheel axis. The immobilizing means preferably includes a flat, "U" shaped skid attached either to the frame or to the handle, such that it extends rearwardly of the rear wheel axis and is substantially parallel to and positioned slightly above the walking surface. A downward force applied to the handle causes the skid to engage the walking surface and immobilize the walker-trainer.

41 Claims, 4 Drawing Sheets

CHILD WALKER-TRAINER

BACKGROUND

1. The Field of the Invention

The invention relates to a device for helping toddlers learn to walk. More particularly, the present invention is a push toy that moves freely as the child walks normally, yet provides firm support if the child falters and loses his balance.

2. The Prior Art

As a child begins to walk, he needs support to maintain proper balance. Typically, this support begins as a parent's guiding hand helping the child take those first steps. Later, as the child gains more confidence, the support may take the form of furniture or walls.

In some cases, the child may attempt to utilize one of the many commercially available push toys for support as the child walks. Unfortunately, most push toys provide little, if any, support if the child falters and loses his balance. Should the child lean or apply weight to the push toy, the toy typically moves away from the child, and the child falls. Furthermore, existing push toys do not provide a way for the child to pull himself up once the child has fallen and is on the ground.

Walkers have been developed to assist in training children to walk. Generally, these walkers contain a forward set of wheels and a rear set of nonslideable support members. In order to move the walker, a child must lift the rear support members and push the walker forward on its wheels. If the child should lose his balance, the rear support members engage the ground and stop any movement of the walker, thereby providing a firm support for the child.

While such walkers would initially appear to meet the needs of most children, these child walkers have several significant drawbacks. Chief among them is that the child must lift the handle in order to move the walker and walk. Because such walkers are generally heavy with a high center of gravity, it is difficult for a young toddler to constantly lift a handle in order to walk. Moreover, lifting a handle is an additional burden placed on young children learning to walk who already struggle to balance and walk simultaneously. Such lifting is not a function of the natural walking "skill" which the child is attempting to learn. Furthermore, constantly lifting on a handle inhibits the child's proper posture and balance development.

In addition, existing child walkers are generally not aesthetically pleasing. They tend to be large and bulky. As a result, such walkers do not entertain the child or hold the child's attention. Consequently, the child avoids using such walker.

From the foregoing, it will be appreciated that what is needed in the art is a child walker-trainer which does not require the handle to be lifted by the child when used.

Additionally, it would be a significant advancement in the art to provide a child walker-trainer which rolls freely during normal walking, yet provides firm support if the child loses balance.

It would be a further advancement in the art to provide a child walker-trainer which is in the form of a push toy which will be enjoyable for the child and which will hold the child's attention.

The foregoing, and other features and objects of the present invention are provided by the invention which is disclosed and claimed herein.

BRIEF SUMMARY AND OBJECTS OF THE INVENTION

The present invention is directed to a child walker-trainer. The walker-trainer consists of a frame to which at least three wheels are mounted, but preferably two rear wheels and two forward wheels are mounted to the frame. At least one of the wheels is mounted axially to the frame to form a rear wheel axis rearward of the other wheels. A sloping handle extending upwardly and rearwardly of the rear wheels is also attached to the frame.

A flat, generally "U" shaped skid is preferably attached either to the frame or to the handle, such that it extends rearwardly of the rear wheel axis and is substantially parallel to, and positioned slightly above, the walking surface. The underside of the skid comprises an engaging surface for frictionally engaging the walking surface upon which the walker-trainer moves.

The walker-trainer is balanced such that the skid surface is substantially parallel to the floor upon which the child walks. Thus, the walker-trainer freely rolls without the necessity of lifting the handle.

In use, a child learning to walk grasps the handle, pulls himself up, and pushes the walker-trainer forward as desired. If the child loses his balance and applies a downward force on the handle, the walker-trainer pivots along the rear wheel axis such that the engaging surface on the skid engages the ground upon which the child was walking. Due to friction between the engaging surface and the surface upon which the child was walking, the walker-trainer quickly stops and remains firm until the child regains his balance and resumes normal walking.

The walker is advantageously configured as a push toy. In this way, the child will be happily entertained for extended periods of time.

It is, therefore, an object of the present invention to provide a child walker-trainer wherein the handle does not need to be lifted when used.

Another important object of the present invention is to provide a child walker-trainer which will roll freely during normal walking, yet provide firm support if the child should lose his balance.

An additional object of the present invention is to provide a child walker-trainer configured as a push toy which will be fun for the child and which will hold the child's attention for extended periods of time.

These and other objects and features of the present invention will become more fully apparent from the following description and appended claims taken in conjunction with the accompanying drawings or may be learned by the practice of the invention.

DETAILED DESCRIPTION OF THE PREFERRED EMBODIMENTS

Figure 1:
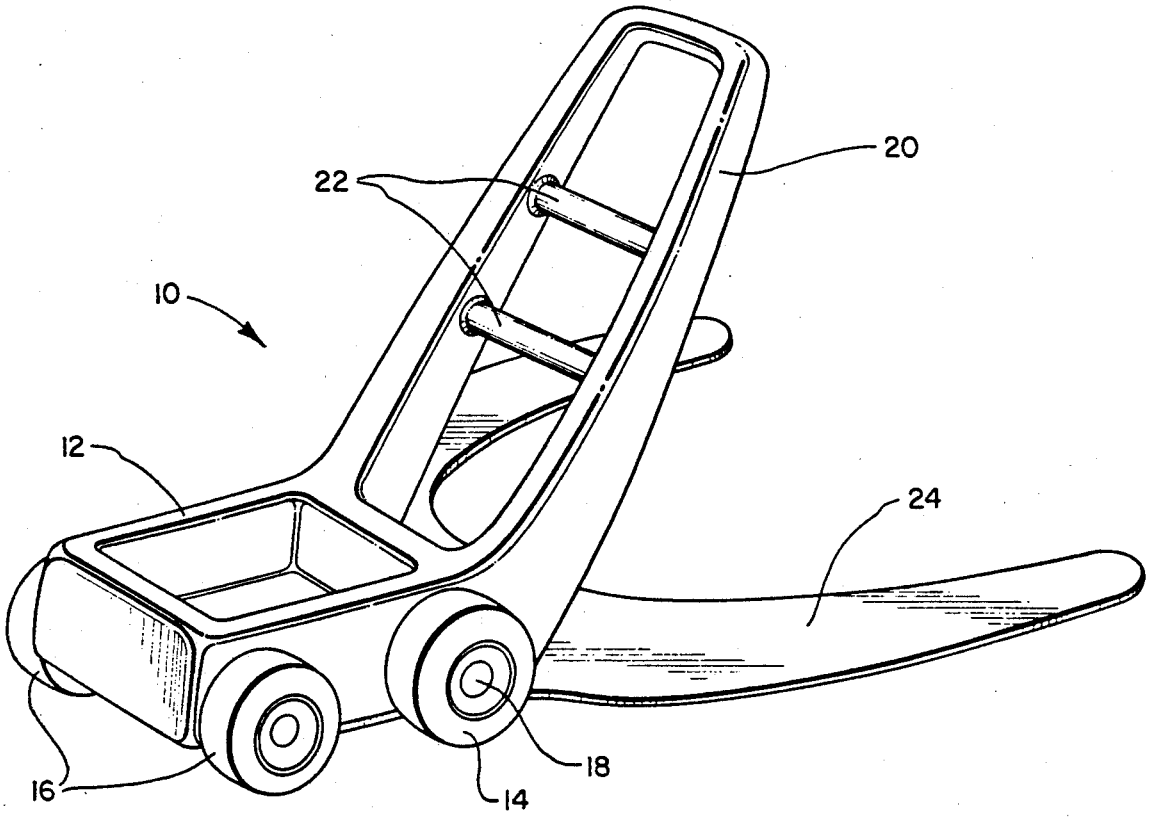
FIG. 1 is a perspective view of one presently preferred embodiment within the scope of the present invention.

Reference is made to the drawings wherein like parts are designated with like numerals throughout. Referring first to FIG. 1, one presently preferred embodiment of the present invention is illustrated and generally designated 10.

Walker-trainer 10 is particularly designed for teaching children to walk. The walker-trainer includes a frame 12, preferably in the form of a push toy. A set of rear wheels 14 and a set of front wheels 16 are attached to frame 12 such that the wheels engage and roll over a substantially planar walking surface 17. Walking surface 17 is preferably an indoor floor surface such as those found in a typical house. At least one rear wheel is mounted axially to the frame to form a rear wheel axis 18. A handle 20, attached to frame 12, extends upwardly and rearwardly of the rear wheels. Secondary handles 22 are preferably located between the handle and the frame.

The walker-trainer advantageously includes means for immobilizing the walker-trainer when the device is pivoted along rear wheel axis 18. When a downward force is applied to handle 20, the immobilizing means engage the walking surface and immobilize the walker-trainer. As hereinafter more fully explained, the means for immobilizing the walker-trainer preferably includes a flat skid extending rearwardly of the rear wheel axis such that the skid is substantially parallel to the walking surface.

Figure 2:
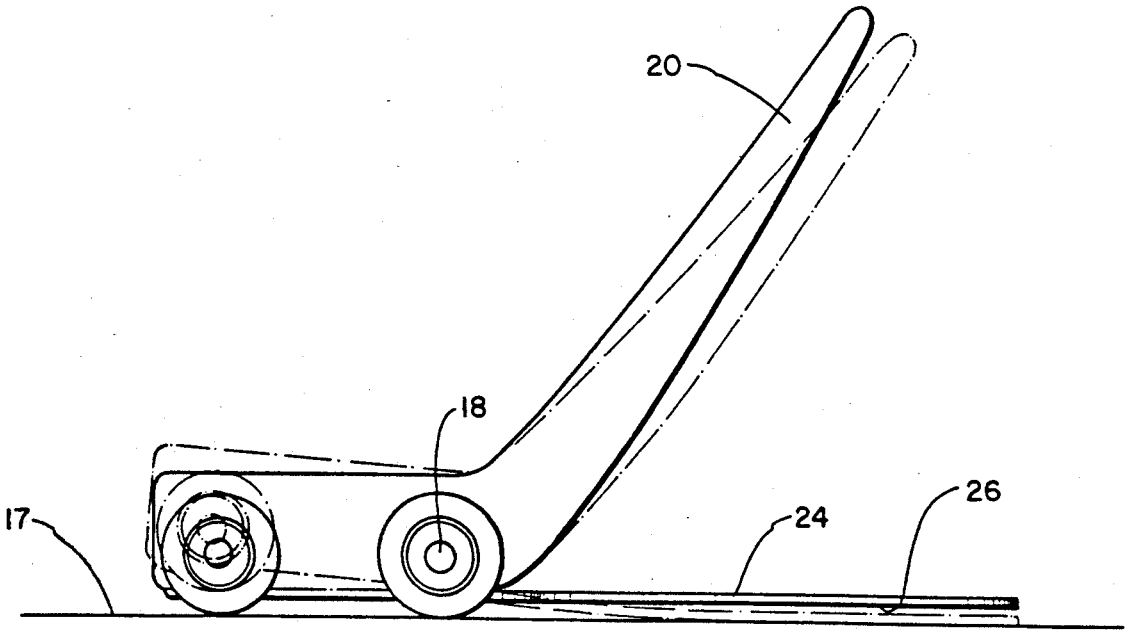
FIG. 2 is a side elevation of the embodiment of the present invention illustrated in FIG. 1 showing the pivoting which occurs at the rear wheel axis when a downward force is applied to the handle, thereby causing the skid to engage the walking surface.
Figure 8:
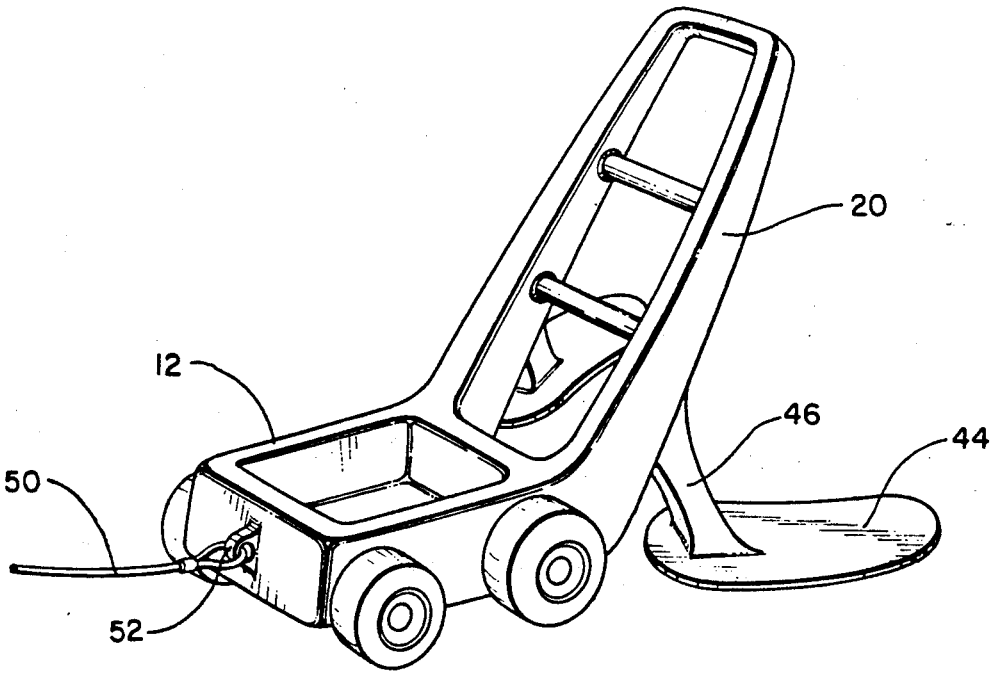
FIG. 8 is a perspective view of yet another embodiment within the scope of the present invention illustrating skids attached directly to the handle.

As illustrated in FIGS. 1 and 2, skid 24 is attached to frame 12. Skid 24 may also be attached directly to handle 20, thereby being indirectly attached to frame 12 through handle 20. FIG. 8 is an embodiment within the scope of the present invention illustrating the skid attached directly to the handle. The skid includes engaging surface 26 for engaging the walking surface.

Skid 24 is preferably flat and in a geometric configuration which will not interfere with the child's legs and feet as the child walks. Skids in the general shape of a parabola, a semi-circle, a "U", a "V", and a horseshoe have been found to be suitable.

The skid is preferably constructed of a strong, lightweight, and flat material. The skid should be strong enough to withstand the leveraged force applied to the skid by pulling downward on handle 20, yet light enough so that the skid does not drag under its own weight. The skid is preferably flat so that the child can easily crawl over the skid in reaching a secondary handle 22 and so that the child can fall on the skid without injury.

The skid is attached to frame 12 in such a way that the skid is substantially parallel to the walking surface upon which the front and rear wheels move. In one currently preferred embodiment of the present invention, skid 24 is removably attached to frame 12. In this way the skid can be removed after the child has learned to walk so that the child can play with the walker-trainer like typical push toys.

Walker-trainer 10 rolls freely on the front and rear wheels, so in practice a child learning to walk only needs to grasp handle 20 and push the walker-trainer in the desired direction. Should the child lose his balance and apply a downward force on handle 20, walker-trainer 10 pivots along rear wheel axis 18 causing engaging surface 26 on skid 24 to engage the walking surface. Due to friction between engaging surface 26 and the walking surface, even a slight downward pressure on handle 20 causes the walker-trainer to be immobilized and permits the child to regain his normal balance.

In most cases, the friction between engaging surface 26 and the walking surface is created from the generally large surface area of skid 24. Nevertheless, the frictional engagement needed to immobilize the walker may be enhanced by altering the surface characteristics of engaging surface 26. For example, means for enhancing the friction between the engaging surface and the walking surface may include adding spikes or knobs to the engaging surface. Alternatively, the engaging surface may be made rough to enhance its friction characteristics. Depending on the degree of friction enhancement added to the engaging surface, the skid may be reduced in size without compromising effectiveness.

Should the child fall to the floor, the child can easily grasp secondary handles 22 which will also cause the device to pivot along the rear wheel axis and cause the engaging surface to engage the ground. In this way, the child can pull himself up through the use of a firm stable support. Once standing again, the child can resume walking by pushing handle 20.

An important feature of the present invention is the pivoting action along the rear wheel axis. The pivoting action causes the engaging surface on the skid to engage the walking surface and immobilize the walker-trainer. Although the foregoing discussion has described the means for immobilizing the walker-trainer in terms of a skid extending rearwardly of the rear wheel axis substantially parallel to the walking surface, it will be appreciated that the immobilizing means may comprise other skid embodiments. In addition, the immobilizing means may include a skid used in combination with locking wheels which lock automatically when the handle is pulled downward. Self locking wheels permit the use of a smaller skid embodiment. Regardless of the embodiment, it is important that the immobilizing means function as a result of a downward force applied to the handle causing a pivoting action about the rear wheel axis.

It has been found that a child learning to walk often wobbles around and frequently ends up in a corner or against a wall or furniture such that the child's progress is impeded. To help guide the child, a cord may be attached to the front of the walker-trainer frame. In this way, a parent can easily reposition the walker-trainer or help the child steer the device away from potential trouble.

One possible mode of attaching a cord to the walker-trainer is illustrated in FIG. 8. Cord 50 is shown attached to a ring 52 located on the front of frame 12. Numerous other methods of attaching cord 50 to frame 12 are known in the art.

Both the front and rear wheels preferably have a diameter large enough to permit the walker-trainer to readily roll over door thresholds, but small enough to maintain a low center of gravity.

The walker-trainer also provides some protection from a child inadvertently pushing the device down a flight of stairs. Should the child begin pushing the device down some stairs, the device pivots along the rear wheel axis effectively raising handle 20. Any compensating downward force on handle 20 causes the engaging surface of skid 24 to engage the ground and immobilize the walker-trainer.

Walker-trainer 10 may be constructed in a variety of different push toy embodiments. For example, the walker-trainer may be configured as a lawn mower, upright vacuum, shopping cart, car, truck, airplane, animal, or any other embodiment which the creative mind can imagine. The limitless variety of potential walker-trainer configurations assures the availability of an embodiment which will entertain the child for extended periods of time. These various embodiments may be readily constructed of durable plastic by injection molding or other suitable processes known in the art. A few representative embodiments within the scope of the present invention are illustrated in FIGS. 1, 3, 4, 5, 6, and 8.

Figure 3:
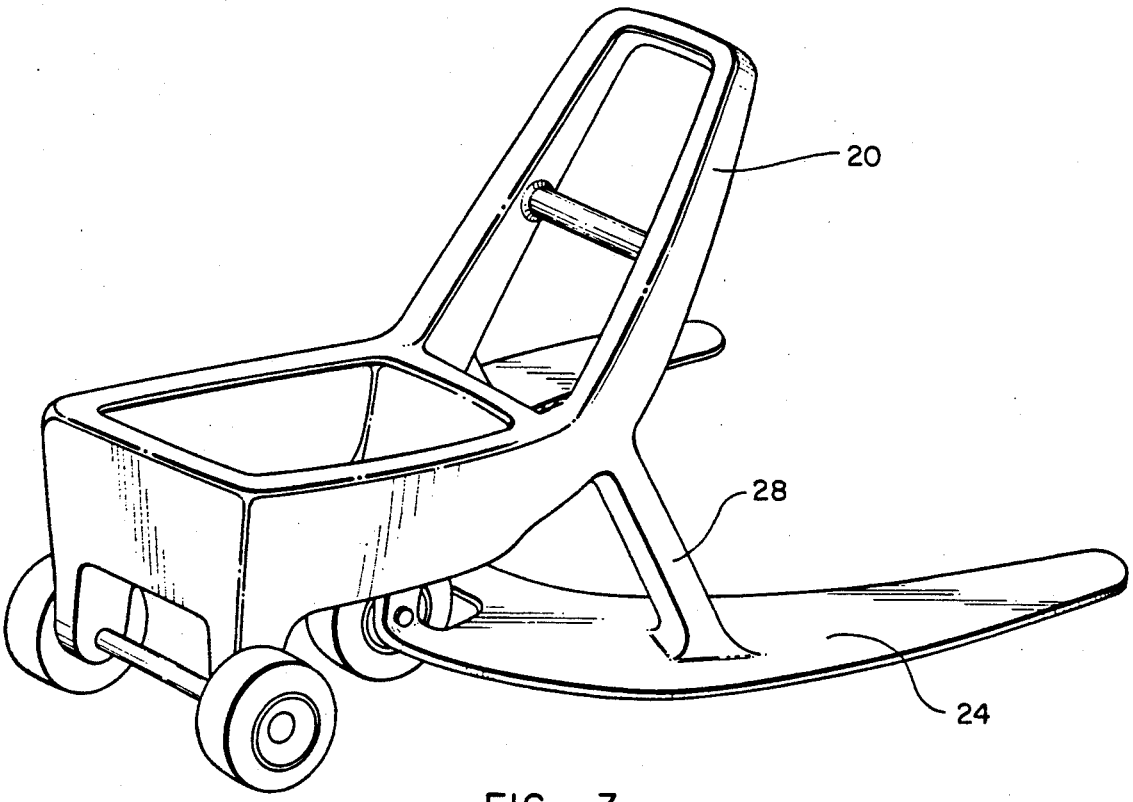
FIG. 3 is a perspective view of another embodiment within the scope of the present invention.
Figure 4:
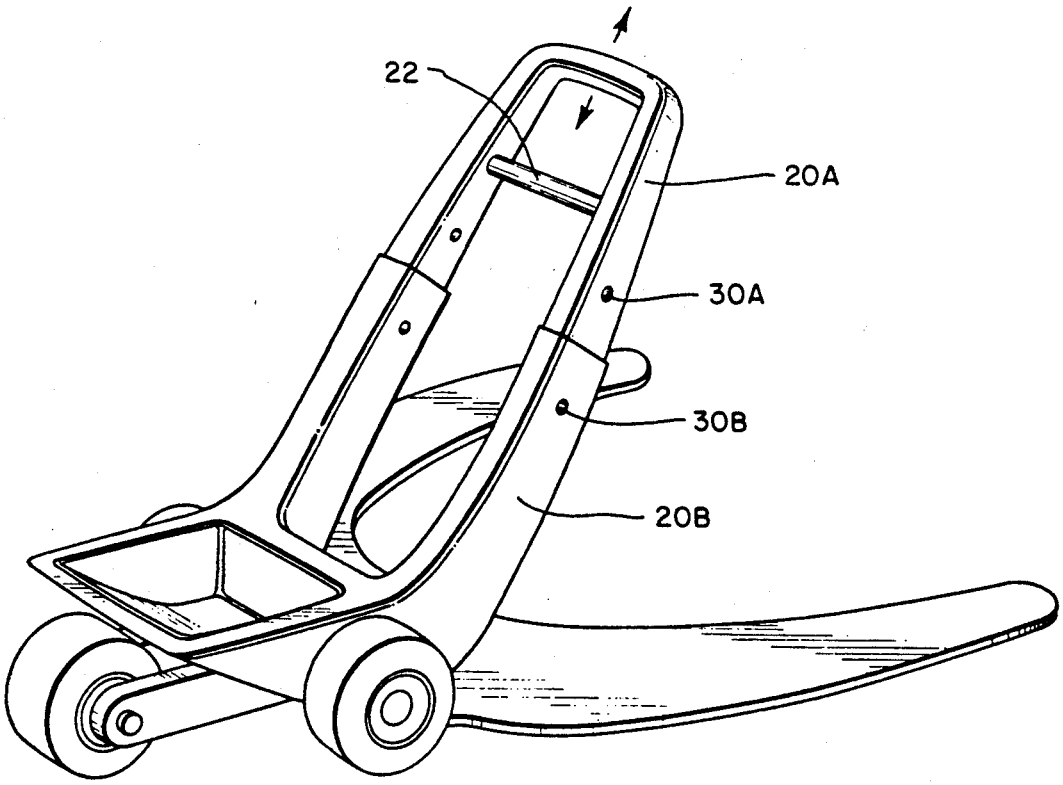
FIG. 4 is a perspective view of yet another embodiment within the scope of the present invention.

It will be appreciated that due to the pivoting action which takes place along the rear wheel axis, the present invention may be constructed with only a single front wheel or only a single rear wheel. Such embodiments are illustrated in FIGS. 3 and 4. In any event, at least three wheels would be needed to allow the walker-trainer to roll freely and maintain vertical stability. In an embodiment with only three wheels, the wheels should be arranged nonlinearly, that is, the points of contact between the wheels and the walking surface should not be linear.

Depending on the embodiment, it may be necessary to add weight to frame 12 in order to counterbalance skid surface 24 and handle 20 and to prevent the skid surface from touching the ground during normal walking by the child. In addition, it may be desirable in some embodiments, such as the embodiment illustrated in FIG. 3, to provide support bars 28 between handle 20 and skid surface 24.

Similarly, it may be desirable to provide means for adjusting the height of handle 20 or the height of secondary handles 22 to accommodate different sized children. The embodiment illustrated in FIG. 4 shows one possible structure for adjusting the height of the handle and secondary handle. The handle is split into an upper handle 20A and a lower handle 20B. Upper handle 20A is slidably located within lower handle 20B. A plurality of holes 30A and 30B are evenly spaced along the length of the upper and lower handles, respectively.

By telescopically sliding upper handle 20A within lower handle 20B, holes 30A may be aligned with holes 30B. Aligned holes 30A and 30B accommodate a pin (not shown) or other means for maintaining the upper and lower handles in position. It will be appreciated that telescopically sliding upper handle 20A into or out of lower handle 20B adjusts the height of both handle 20A and secondary handle 22.

Figure 5:
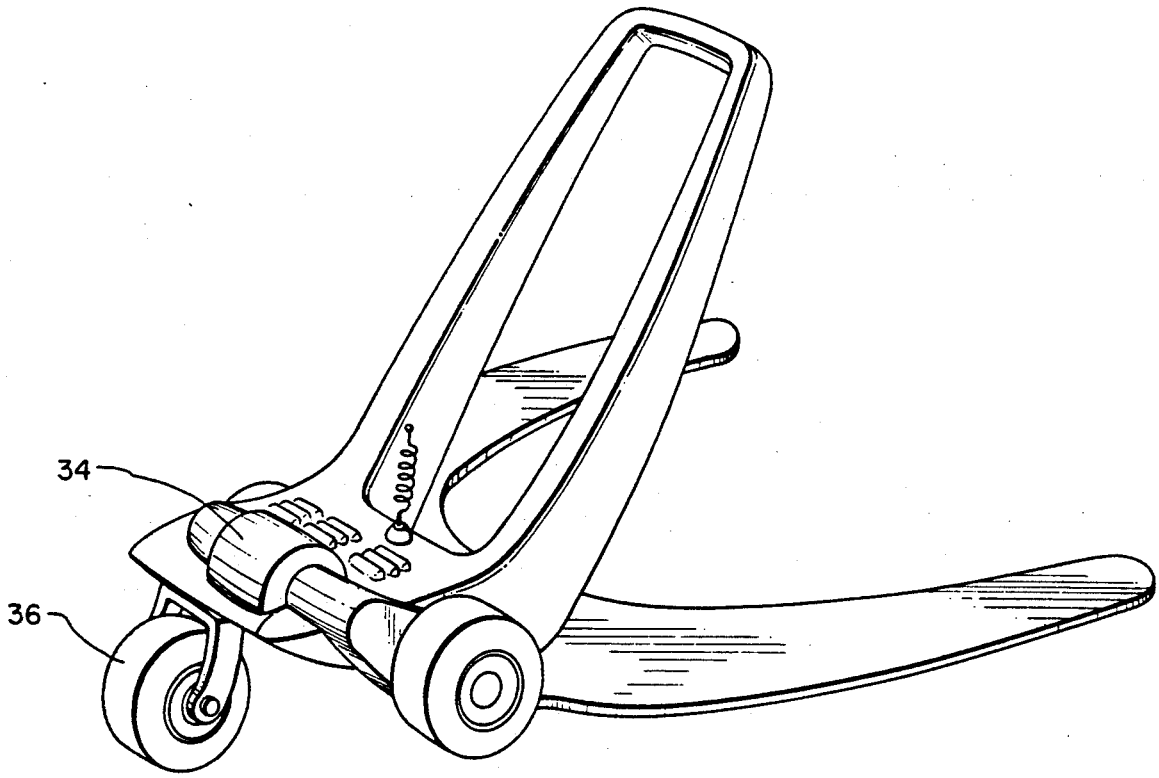
FIG. 5 is a perspective view of yet another embodiment within the scope of the present invention illustrating a remote controlled, motor driven and guided walker-trainer.

The embodiment within the scope of the present invention illustrated in FIG. 5 contains a remote controlled motor 34 which drives the device and steers front wheel 36. In this way, the child learning to walk can be guided in his footsteps by the person controlling the motor-driven walker-trainer. The child is encouraged to walk rather than merely stand still holding the handle. A motor driven walker-trainer increases the enjoyment for both operator and child. Remote controlled motor and guidance systems known in the art may be readily adapted for use in connection with the present invention.

Figure 6:
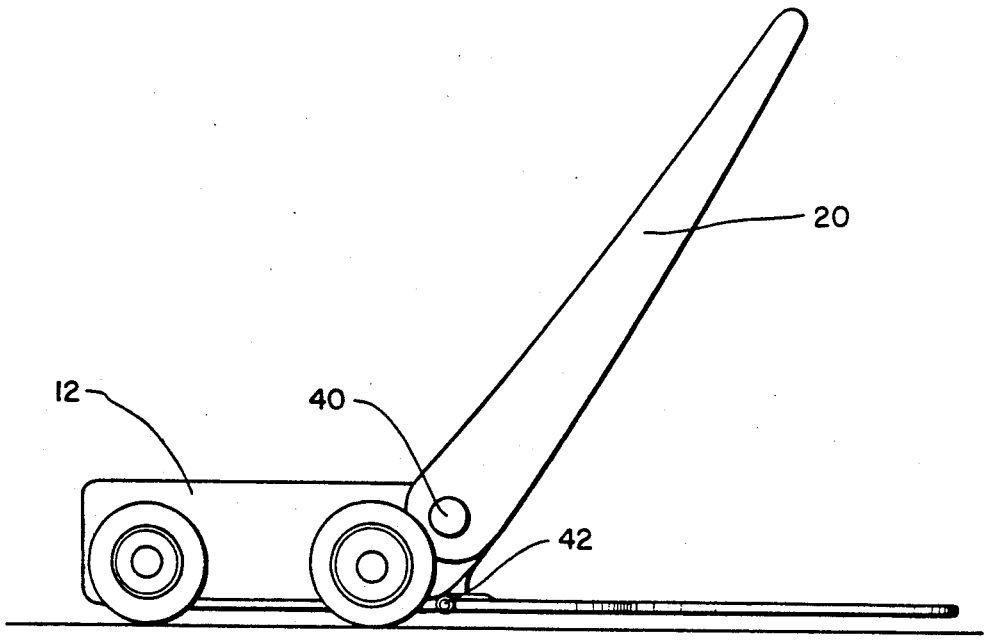
FIG. 6 is a side elevation view of one embodiment within the scope of the present invention which is collapsible.
Figure 7:
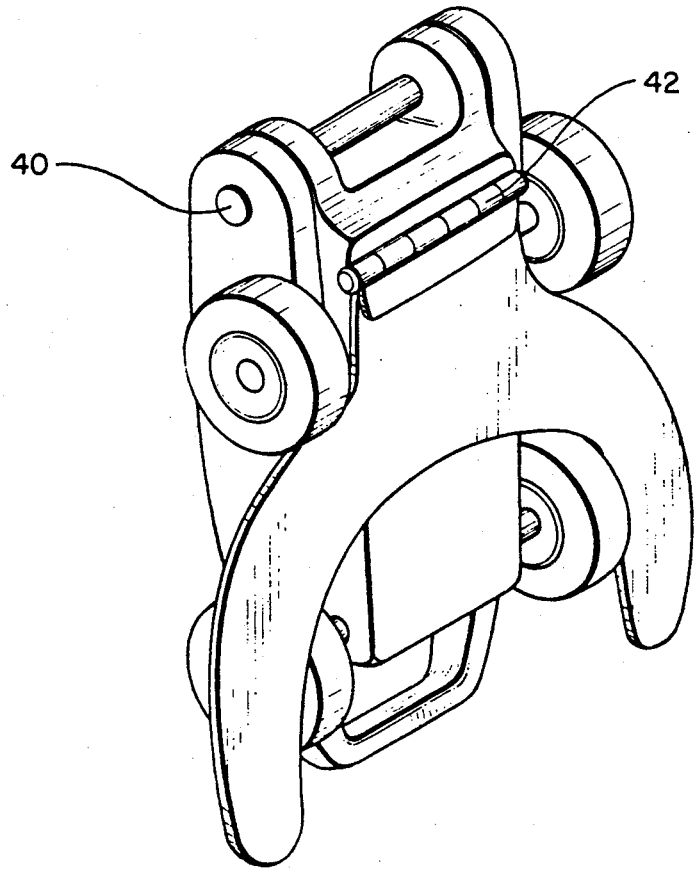
FIG. 7 is a perspective view of the embodiment of the present invention illustrated in FIG. 6 showing the apparatus collapsed for easy packing and storage.

FIGS. 6 and 7 illustrate an embodiment within the scope of the present invention which is collapsible. A handle hinge 40, located between handle 20 and frame 12, enables the handle to be folded on top of the frame. If desired, the handle may be removable for easy packing and storage of the walker-trainer. In addition, skid hinge 42, located near the point of skid attachment, permits the skid to be folded adjacent to the frame for easy packing and storage of the walker-trainer. FIG. 7 shows the embodiment of FIG. 6 fully collapsed.

As discussed above, FIG. 8 illustrates another embodiment within the scope of the present invention wherein skid 44 is attached directly to handle 20 through support member 46.

From the foregoing, it will be appreciated that the present invention provides a child walker-trainer which may be used without the necessity of lifting a handle. This is accomplished by providing at least three wheels which roll freely during normal walking and which counterbalance a skid surface substantially parallel to the floor upon which the walker-trainer rolls.

Additionally, it will be appreciated that the present invention provides a child walker-trainer which provides firm support if the child loses his balance. A force downwardly applied to the handle causes the skid surface to engage the ground and immobilize the walker-trainer. In this way, the walker-trainer provides a firm support for the child until the child regains his normal balance.

It will also be appreciated that the present invention provides a child walker-trainer configured as a push toy which will be enjoyable for the child and which will hold the child's attention for extended periods of time.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by U.S. Letters Patent is:

1. A child walker-trainer comprising:

a frame having at least three wheels mounted thereon such that the wheels engage a substantially planar walking surface upon which the walker-trainer moves, at least one of the wheels being mounted axially to the frame to form a rear wheel axis rearward of the other wheels;

a handle attached to the frame which extends upwardly and rearwardly of the rear wheel axis such that a downward force applied to said handle causes the walker-trainer to pivot about the rear wheel axis; and means for immobilizing the walker-trainer when the walker-trainer is pivoted about the rear wheel axis such that when no downward force is applied to the handle the immobilizing means is essentially disengaged so that the walker-trainer moves freely on the wheels, and when a downward force is applied to the handle, the immobilizing means is engaged so that the walker-trainer is substantially immobilized.

2. A child walker-trainer as defined in claim 1, further comprising at least two rear wheels mounted axially to the frame to form a rear wheel axis and at least two front wheels mounted axially to the frame forward of said rear wheels such that said front wheels and said rear wheels engage the walking surface upon which the walker-trainer moves.

3. A child walker-trainer as defined in claim 1, wherein the frame is configured as a push toy.

4. A child walker-trainer as defined in claim 3, wherein the frame comprises durable molded plastic.

5. A child walker-trainer as defined in claim 1, wherein the means for immobilizing the walker-trainer comprises a flat skid attached to the frame and extending rearwardly of the rear wheel axis such that said skid is substantially parallel to the walking surface.

6. A child walker-trainer as defined in claim 5, wherein the skid is shaped in a geometric configuration which does not interfere with the legs and feet of the user.

7. A child walker-trainer as defined in claim 6, wherein the skid is "U" shaped.

8. A child walker-trainer as defined in claim 5, wherein the skid has an engaging surface for engaging the planar surface.

9. A child walker-trainer as defined in claim 8, wherein the engaging surface comprises means for enhancing the friction between the engaging surface and the walking surface.

10. A child walker-trainer as defined in clam 5, wherein the skid is removably attached to the frame.

11. A child walker-trainer as defined in claim 5, wherein weight is added to the frame to counterbalance the weight of the skid such that the walker-trainer rolls freely over the walking surface.

12. A child walker-trainer as defined in claim 5, further comprising support bars located between the handle and the skid.

13. A child walker-trainer as defined in claim 1, further comprising at least one secondary handle located between the handle and the frame.

14. A child walker-trainer as defined in claim 1, further comprising a remote controlled motor to drive and control the movement of the walker-trainer.

15. A child walker-trainer as defined in claim 10, wherein the handle is removable for easy packing and storage of the walker-trainer.

16. A child walker-trainer as defined in claim 1, further comprising a cord attached to the frame to permit control over the movement and direction of the walker-trainer.

17. A child walker-trainer comprising:

a frame configured as a push toy having at least two rear wheels mounted axially thereon to form a rear wheel axis and at least one front wheel mounted axially thereon forward of the rear wheels such that the front wheel and the rear wheels engage a substantially planar walking surface upon which the walker-trainer moves;

a handle attached to the frame in alignment with the rear wheel axis which extends upwardly and rearwardly of the rear wheel axis, such that a downward force applied to said handle causes the walker-trainer to pivot about the rear wheel axis; and means for immobilizing the walker-trainer when the walker-trainer is pivoted about the rear wheel axis such that when no downward force is applied to the handle the immobilizing means is essentially disengaged so that the walker-trainer moves freely on the wheels, and when a downward force is applied to the handle, the immobilizing means is engaged so that the walker-trainer is substantially immobilized.

18. A child walker-trainer as defined in claim 17, wherein the means for immobilizing the walker-trainer comprises a flat skid attached to the frame and extending rearwardly of the rear wheel axis such that said skid is substantially parallel to the walking surface.

19. A child walker-trainer as defined in claim 18, wherein the skid is shaped in a geometric configuration which does not interfere with the legs and feet of the user.

20. A child walker-trainer as defined in claim 19, wherein the skid is "U" shaped.

21. A child walker-trainer as defined in claim 18, wherein the skid has an engaging surface for engaging the walking surface.

22. A child walker-trainer as defined in claim 21, wherein the engaging surface comprises means for enhancing the friction between the engaging surface and the walking surface.

23. A child walker-trainer as defined in clam 18, wherein the skid is removably attached to the frame.

24. A child walker-trainer as defined in claim 18, wherein weight is added to the frame to counterbalance the weight of the skid such that the walker-trainer will roll freely over the walking surface.

25. A child walker-trainer as defined in claim 18, further comprising support bars located between the handle and the skid.

26. A child walker-trainer as defined in claim 17, further comprising at least one secondary handle located between the handle and the frame.

27. A child walker-trainer as defined in claim 17, further comprising a remote controlled motor to drive and control the movement of the walker-trainer.

28. A child walker-trainer as defined in claim 17, wherein the handle is removable for easy packing and storage of the walker-trainer.

29. A child walker-trainer as defined in claim 17, wherein the frame comprises durable molded plastic.

30. A child walker-trainer as defined in claim 17, further comprising at least two front wheels mounted axially to the frame forward at the rear wheels such that said front wheels and the rear wheels engage the walking surface.

31. A child walker-trainer as defined in claim 17, further comprising a cord attached to the frame to permit control over the movement and direction of the walker-trainer.

32. A child walker-trainer comprising:

a frame configured as a push toy having at least two rear wheels mounted axially thereon to form a rear wheel axis and at least two front wheels mounted axially thereon forward of the rear wheels such that the front wheels and the rear wheels engage a substantially planar walking surface upon which the walker-trainer moves;

a flat skid attached to the frame and extending rearwardly of the rear wheels such that said skid is substantially parallel to the planar surface, said skid being shaped in a geometric configuration which does not interfere with the legs and feet of the user, said skid having an engaging surface for engaging the walking surface; and a handle attached to the frame which extends upwardly and rearwardly of the rear wheel axis such that a downward force applied to said handle causes the walker-trainer to pivot about the rear wheel axis thereby causing the engaging surface of the skid to engage the walking surface and substantially immobilize the walker-trainer, said rear wheels being otherwise free to rotate and roll said walker-trainer freely over the walking surface.

33. A child walker-trainer as defined in claim 32, wherein the skid is "U" shaped.

34. A child walker-trainer as defined in clam 32, wherein the skid is removably attached to the frame.

35. A child walker-trainer as defined in claim 34, wherein the handle is removable for easy packing and storage of the walker-trainer.

36. A child walker-trainer as defined in claim 32, wherein weight is added to the frame to counterbalance the weight of the skid such that the walker-trainer will roll freely over the walking surface.

37. A child walker-trainer as defined in claim 32, further comprising support bars located between the handle and the skid.

38. A child walker-trainer as defined in claim 32, further comprising at least one secondary handle located between the handle and the frame.

39. A child walker-trainer as defined in claim 32, further comprising a remote controlled motor to drive and control the movement of the walker-trainer.

40. A child walker-trainer as defined in claim 32, further comprising means for locking the rear wheels when a downward force is applied to the handle which causes the walker-trainer to pivot about the rear wheel axis.

41. A child walker-trainer as defined in claim 32, further comprising a cord attached to the frame to permit control over the movement and direction of the walker-trainer.

* * * * *